US011241727B2

(12) United States Patent
Ockenfuss et al.

(10) Patent No.: US 11,241,727 B2
(45) Date of Patent: Feb. 8, 2022

(54) MACHINING PLANAR WORKPIECES

(71) Applicant: TRUMPF Werkzeugmaschinen GmbH + Co. KG, Ditzingen (DE)

(72) Inventors: Simon Ockenfuss, Boeblingen (DE); Rainer Hank, Eberdingen/Hochdorf (DE); Marc Klinkhammer, Ditzingen (DE); Leonard Schindewolf, Rutesheim (DE); Jens Kappes, Leinfelden-Echterdingen (DE); Dennis Traenklein, Nufringen (DE); Alexander Tatarczyk, Hoeffingen (DE); Joerg Neupert, Stuttgart (DE); Dominik Bitto, Muenchingen (DE); Markus Maatz, Leinfelden-Echterdingen (DE); Christian Jakisch, Boeblingen (DE); Markus Wilhelm, Gerlingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 16/363,167

(22) Filed: Mar. 25, 2019

(65) Prior Publication Data

US 2019/0299272 A1 Oct. 3, 2019

Related U.S. Application Data

(63) Continuation of application No. PCT/EP2017/074296, filed on Sep. 26, 2017.

(30) Foreign Application Priority Data

Sep. 26, 2016 (DE) ..... 102016118175.7
Oct. 12, 2016 (DE) ..... 102016119434.4

(51) Int. Cl.
*B21D 28/26* (2006.01)
*B21D 28/04* (2006.01)
(Continued)

(52) U.S. Cl.
CPC ..... *B21D 28/265* (2013.01); *B21D 28/02* (2013.01); *B21D 28/04* (2013.01); *B21D 28/125* (2013.01);
(Continued)

(58) Field of Classification Search
CPC ..... Y10T 83/9437; Y10T 83/944; B26F 1/40; B26F 1/44; B26F 2001/4427;
(Continued)

(56) References Cited

U.S. PATENT DOCUMENTS 522,953 A * 7/1894 Bradley ..... B21D 28/34 83/685
2,035,448 A * 3/1936 Andersson ..... B23D 27/00 83/145
(Continued)

FOREIGN PATENT DOCUMENTS

DE 4235972 4/1994
DE 102006049044 * 4/2008
(Continued)

OTHER PUBLICATIONS

International Preliminary Report on Patentability in International Application No. PCT/EP2017/074296, dated Mar. 26, 2019, 7 pages (English translation).
(Continued)

*Primary Examiner* — Ghassem Alie
*Assistant Examiner* — Samuel A Davies
(74) *Attorney, Agent, or Firm* — Fish & Richardson P.C.

(57) ABSTRACT

A machine for machining, such as cutting and/or forming, planar workpieces has an upper tool and a lower tool that are
(Continued)

movable toward each other to machine a workpiece arranged therebetween. The upper tool includes at least one cutting tool having at least one cutting edge and a clamping shaft. The lower tool includes a main body having a support surface for the workpiece. The support surface has an opening associated with an inner counter cutting edge. The lower tool has a positioning axis and at least one outer counter cutting edge provided outside of the opening and associated with the support surface. The outer counter cutting edge is aligned with an outer face of the support surface. A distance of the outer counter cutting edge from the position axis and a distance of the inner counter cutting edge from the position axis deviate from each other.

14 Claims, 9 Drawing Sheets

(51) Int. Cl.

| | |
|---|---|
| ***B21D 28/12*** | (2006.01) |
| ***B21D 28/14*** | (2006.01) |
| ***B21D 28/32*** | (2006.01) |
| ***B21D 45/04*** | (2006.01) |
| ***B21D 28/34*** | (2006.01) |
| ***B21D 28/02*** | (2006.01) |
| ***B26F 1/40*** | (2006.01) |
| ***B26F 1/44*** | (2006.01) |

(52) U.S. Cl.
CPC ..... *B21D 28/14* (2013.01); *B21D 28/325* (2013.01); *B21D 28/34* (2013.01); *B21D 45/04* (2013.01); *B26F 1/40* (2013.01); *B26F 1/44* (2013.01); *B26F 2001/4427* (2013.01); *B26F 2001/4445* (2013.01); *B26F 2001/4481* (2013.01)

(58) Field of Classification Search
CPC ..... B26F 2001/4445; B26F 2001/4481; B26F 1/14; B26F 2001/4418; B21D 28/02; B21D 28/125; B21D 28/14; B21D 28/246; B21D 28/26; B21D 28/265; B21D 28/325; B21D 28/34; B21D 35/001; B21D 37/08; B21D 45/04; B21D 28/20; B23D 27/00–06
USPC ..... 83/553, 916; 30/358–368
See application file for complete search history.

(56) References Cited

U.S. PATENT DOCUMENTS

| | | | | | |
|---|---|---|---|---|---|
| 2,684,717 | A * | 7/1954 | Jones | C14B 5/00 | 83/553 |
| 3,269,240 | A * | 8/1966 | Killaly | B21D 28/34 | 83/140 |
| 3,370,492 | A * | 2/1968 | Treff | B26D 7/24 | 83/76.7 |
| 3,613,491 | A * | 10/1971 | Kahmann | B21D 28/265 | 83/146 |
| 3,785,236 | A * | 1/1974 | Peterson | B21D 28/06 | 83/694 |
| 4,343,210 | A * | 8/1982 | Kuroyone | B21D 28/04 | 72/20.3 |
| 4,698,480 | A * | 10/1987 | Klingel | B21D 28/12 | 219/121.39 |
| 4,738,173 | A * | 4/1988 | Kiuchi | B21D 28/12 | 83/34 |
| 4,929,276 | A * | 5/1990 | Chun | B21D 28/12 | 83/139 |
| 5,195,413 | A * | 3/1993 | Johnson | B23D 15/06 | 83/132 |
| 5,392,629 | A * | 2/1995 | Goss | B21D 22/04 | 29/6.1 |
| 5,400,682 | A * | 3/1995 | Matsuura | B21D 28/12 | 83/49 |
| 5,499,566 | A * | 3/1996 | Endo | B21D 28/34 | 83/49 |
| 6,125,520 | A * | 10/2000 | Lindsey | B23D 31/002 | 29/412 |
| 6,189,361 | B1 * | 2/2001 | Seki | B21C 51/005 | 72/325 |
| 6,505,535 | B1 * | 1/2003 | Kurita | B21D 35/00 | 83/220 |
| 6,527,687 | B1 * | 3/2003 | Fortney | B26F 1/40 | 493/56 |
| 6,644,089 | B1 * | 11/2003 | Gorgen | B21D 39/021 | 29/243.58 |
| 6,675,688 | B2 * | 1/2004 | Ostini | B21D 28/12 | 83/549 |
| 2006/0027626 | A1 * | 2/2006 | Endo | B21D 5/045 | 228/101 |
| 2009/0211326 | A1 * | 8/2009 | Laib | B21D 28/24 | 72/332 |
| 2009/0223273 | A1 * | 9/2009 | Erlenmaier | B21D 28/125 | 72/407 |
| 2010/0095815 | A1 * | 4/2010 | Laib | B21D 45/003 | 83/23 |
| 2010/0139470 | A1 * | 6/2010 | Buettner | B21D 28/34 | 83/681 |
| 2014/0017443 | A1 * | 1/2014 | Matsuda | B21D 22/022 | 428/131 |
| 2014/0090443 | A1 * | 4/2014 | Schmauder | B21D 28/20 | 72/452.9 |
| 2019/0217367 | A1 * | 7/2019 | Klinkhammer | B21D 28/34 | |

FOREIGN PATENT DOCUMENTS

| | | |
|---|---|---|
| DE | 202008003915 | 5/2008 |
| EP | 2177289 | 7/2011 |
| EP | 2527058 | 7/2014 |
| EP | 3106241 | 12/2016 |

OTHER PUBLICATIONS

International Search Report and Written Opinion in International Application No. PCT/EP2017/074296, 16 pages (with English translation).

* cited by examiner

MACHINING PLANAR WORKPIECES

CROSS REFERENCE TO RELATED APPLICATIONS

This application is a continuation of and claims priority under 35 U.S.C. § 120 from PCT Application No. PCT/EP2017/074296 filed on Sep. 26, 2017, which claims priority from German Application No. 10 2016 118 175.7, filed on Sep. 26, 2016, and German Application No. 10 2016 119 434.4, filed on Oct. 12, 2016. The entire contents of each of these priority applications are incorporated herein by reference.

TECHNICAL FIELD

The invention relates to a tool, machine tool and a method for machining, such as cutting and/or forming, planar workpieces, preferably metal sheets.

BACKGROUND

Such a machine tool is known from EP 2 527 058 B1. This document discloses a machine tool in the form of a press for machining workpieces, wherein an upper tool is provided on a stroke device, which is movable, relative to a workpiece to be machined, along a stroke axis in the direction of the workpiece and in the opposite direction. A lower tool is provided in the stroke axis and opposite the upper tool and is positioned towards a lower side. A stroke drive device for a stroke movement of the upper tool is controlled by a wedge gear. The stroke drive device with the upper tool arranged thereon is movable by a motor drive along a positioning axis. The lower tool is moved synchronously with the upper tool by a motor drive.

A tool for machining planar workpieces is known from DE 10 2006 049 044 A1, which tool can be used in a machine tool according to EP 2 527 058 B1, for example. This tool for cutting and/or forming planar workpieces comprises an upper tool and a lower tool. To machine a workpiece arranged between the upper tool and the lower tool, these are moved towards one another in a stroke direction. A cutting tool with a cutting edge is arranged on the upper tool, and at least two counter cutting edges are provided on the lower tool. The upper tool and the lower tool can be rotated relative to one another about a common positioning axis. The counter cutting edges here are oriented to the common positioning axis in such a way that the cutting edge of the cutting tool may be positioned relative to the counter cutting edges by a rotary movement of the cutting tool of the upper tool. In their distance from the positioning axis the counter cutting edges correspond to the distance of the cutting edge from the common positioning axis.

Furthermore, a tool is known from EP 2 177 289 B1 for cutting and/or forming planar workpieces. This tool comprises an upper tool and a lower tool, which are again oriented towards one another in a common positioning axis. The upper tool is pivoted about this positioning axis, so that at least one cutting edge of a cutting tool on the upper tool may be oriented to the at least one counter cutting edge on the lower tool. In a rest surface for a workpiece the lower tool comprises an opening, through which severed workpiece parts can be discharged. Adjacent to the opening another counter cutting edge is provided, which has the same distance from the positioning axis as the other counter cutting edge in the opening. At the counter cutting edge of the lower tool lying outside the opening there is provided a discharge surface of the sheet. On this tool also the distance of the counter cutting edges from the positioning axis corresponds to the distance of the cutting edge on the cutting tool of the upper tool from the positioning axis.

From DE 42 35 972 A1 a tool for cutting planar sheets is known, which has an upper tool and a lower tool for machining a workpiece arranged in between. The upper tool comprises at least one cutting tool with at least one cutting edge. The lower tool comprises a main body and a scraper, which together have a rest surface for the workpiece. Openings are provided in the main body of the lower tool, which are adapted to the cutting tools of the upper tool in size and contour, in order to eject a punched workpiece part downwardly through the opening.

SUMMARY

One of the objects of the invention is to propose a tool, machine tool and a method for cutting and/or forming planar workpieces, by means of which the versatility of the machining of workpieces is increased.

One aspect of the invention features a tool for cutting and/or shaping planar workpieces, in particular metal sheets. The tool includes an upper tool and a lower tool. The upper tool and the lower tool are movable towards one another for machining a workpiece arranged therebetween. The upper tool includes at least one cutting tool with at least one cutting edge and a clamping shaft, and the upper tool has a positioning axis. The lower tool includes a main body having a rest surface for the workpiece with an opening, with which an inner counter cutting edge is associated, to eject a workpiece part formed following separation downwardly through the opening, and the lower tool has a positioning axis. The lower tool includes at least one outer counter cutting edge provided outside of the opening and associated with the rest surface.

In this tool it is proposed according to the invention that the outer counter cutting edge is oriented towards an outer side of the rest surface bordering the rest surface, and that a distance of the outer counter cutting edge from the positioning axis or longitudinal axis of the main body of the lower tool and a distance of the inner counter cutting edge from the positioning axis or longitudinal axis of the main body of the lower tool differ from one another. The versatility of both the machining of workpieces and for stamping workpiece parts, which are held to a sheet skeleton by means of a remaining connection (micro joint), for example, is increased by this. The process duration may be reduced by such a tool and thus an increase in production per work cycle may be achieved. Such a tool may be used in a punch-machining machine, for example. The upper tool and/or the lower tool can be oriented towards one another together or independently of one another before a stroke movement in at least one traversing axis or positioning axis perpendicular to the vertical axis of rotation or positioning axis. Furthermore, this tool can be used even in a machine tool in which both a superposing of a rotary movement about the vertical stroke axis and a traversing movement along the vertical stroke axis, and along a traversing axis oriented perpendicularly thereto, is facilitated. A simple orientation for introducing a cutting gap or an orientation towards a cutting gap and/or a remaining connection for a subsequent machining step by the inner and outer counter cutting edges relative to the cutting edges of the upper tool is facilitated by such a tool. Furthermore, a simple orientation towards a remaining connection to be separated is facilitated. Moreover, the distance between an upper cutting edge on the upper tool and a counter cutting edge on the lower tool is easily adjustable.

The size of the opening in the main body of the lower tool is preferably a multiple of an end face of the at least one cutting tool of the upper tool. The opening preferably corresponds to at least 1.5 times or at least 2 times the end face or the end side of the at least one cutting tool. Larger workpiece parts, which may be both good parts and residual parts, may thereby be discharged downwardly through the opening in the lower tool. At the same time, a high level of versatility may be provided to associate the at least one cutting edge of the cutting tool with the counter cutting edges on the lower tool. This can increase the versatility in the use of such a tool. The cutting tool may be moved with its end face or end side for a separating or cutting process flush with the opening plane or dip into the opening in the main body of the lower tool.

Furthermore, the inner and outer counter cutting edge are preferably formed on the main body of the lower tool as an open cutting edge. For the inner counter cutting edge, which is associated with the opening of the main body, this means that this does not extend completely circumferentially along the opening edge of the opening, but only over a partial area along the opening. This applies similarly to the outer counter cutting edge also, which extends only over a partial area along an outside of the rest surface on the main body of the lower tool. Due to such opening cutting edges on the lower tool, a separation can take place in particular of a first workpiece part relative to a second workpiece part, which are connected to one another in particular by so-called microjoints.

It is preferably provided that the inner and the outer counter cutting edge of the lower tool are positioned lying opposite one another relative to the rest surface on the lower tool and are oriented to one another without an angular offset. The angular offset refers to the positioning axis of the lower tool. The counter cutting edges are thus preferably oriented parallel to one another. This makes it possible, by a relatively small traversing movement of the upper tool along just one axis, to orient the cutting edge of the upper tool first towards the inner counter cutting edge of the lower tool, for example, and in a subsequent work step towards the outer counter cutting edge. Such a work situation can occur, for example, if a workpiece part is cut free on the inner counter cutting edge and discharged through the opening of the lower tool and following this removal of a further workpiece part outside the lower tool is to be performed by the outer counter cutting edge. A parts separation can thereby be achieved at the same time, in order to separate good and waste parts, for example, from one another, or to separate large and small workpiece parts from one another and supply them to the respective storage container.

Another alternative configuration of the lower tool provides that the inner and outer counter cutting edge are offset at an angle to one another, in particular that the inner and outer counter cutting edge are oriented offset to one another by 180°.

The inner and/or outer counter cutting edge of the lower tool can be arranged detachably on the main body of the lower tool. These are preferably formed as a cutting plate or cutting insert. A simple exchange of the counter cutting edges can thereby take place in the event of wear. Alternatively, geometries of the counter cutting edges adapted to certain applications can also be used. Alternatively, the at least one counter cutting edge can also be formed directly on the main body.

The configuration of the inner and outer counter cutting edge is advantageously on the same cutting insert. The set-up time can be reduced by this.

In addition to the at least one counter cutting edge, a guard strip can be provided on one or both sides. These guard strips can be configured flexibly and received on the main body of the lower tool. Catching on a workpiece that is traversable with respect to the lower tool, in particular with respect to a workpiece part held on the workpiece by a remaining connection, can be reduced by this.

Furthermore, it is advantageously provided that adjoining the inner and/or outer counter cutting edge is a punch surface, which is oriented opposite to a rest surface on the upper tool.

In one embodiment of the lower tool, it can be provided that the inner counter cutting edge is formed protruding into the opening and projecting radially inwards with respect to an opening edge. A secure separation and subsequent discharge of the cut-free workpiece part through the opening of the lower tool is thereby enabled.

Alternatively the lower tool can have an inner counter cutting edge, which forms a delimitation of the rest surface of the lower tool. A plurality of cutting positions may be assumed thereby, due to which the versatility is also increased further.

Another preferred embodiment of the lower tool for the tool provides that on the main body of the lower tool, formed directly thereon or attached detachably thereto, one or more secondary cutting edges are provided, which protrude with respect to the main body as at least one outer counter cutting edge. The secondary cutting edge or these secondary cutting edges may be provided on an adapter plate, which may preferably be attached detachably to the main body. This can be attached detachably by a screw connection, for example. Particular profiles of slots and/or cutting gaps and/or workpiece parts can thereby be separated in a process-safe manner also with regard to the geometry of a cutting edge.

The lower tool comprises an opening in the main body, whereby an annular main body is preferably formed. The wall thickness of the annular body can determine the spacing of the inner and outer counter cutting edge. A positioning axis or a longitudinal center line of the lower tool lies here preferably inside the opening in the main body. For high versatility and to sort and discharge a plurality of workpiece parts, the opening in the main body of the lower tool is formed large, meaning that the wall thickness of the annular main body is reduced to a minimum.

It is preferably provided that adjoining the inner and/or outer counter cutting edge or associated with this, at least one discharge surface is arranged on the main body of the lower tool, which surface is preferably provided interchangeably thereon. The removal of the cut workpiece part may be made easier by such a discharge surface. Moreover, a targeted discharge into a discharge channel or collection container may be achieved. Simple adaptation to different workpiece parts or conditions for discharging workpiece parts may be facilitated by the interchangeable assembly. Defective components can easily be exchanged for new components.

Furthermore, it is preferably provided that the outer edges bordering the rest surface of the lower tool are rounded or chamfered. Catching on the workpiece guided along thereon can be reduced by this.

A preferred embodiment of the lower tool provides that adjacent to the outer counter cutting edge and bordering the rest surface of the lower tool on the main body there is provided an approach ramp, which preferably extends starting out from the outer counter cutting edge in and against the circumferential direction of the rest surface. In the latter case, the approach ramp is formed semicircular. These approach ramps formed adjacent to the outer counter cutting edge have the advantage that increased process reliability is achieved. On traversing of the lower tool, individual workpiece parts machined in the workpiece can be returned along the approach ramp to the workpiece plane, whereby a catching or jamming with the outer counter cutting edge is prevented at the same time.

On the lower tool, on which the outer counter cutting edge has a spacing from the longitudinal center line of the main body that deviates from the inner counter cutting edge relative to the longitudinal center line of the main body, an upper tool may be used on which the cutting tool of the upper tool is positioned both centrally and eccentric to the rotary axis of the upper tool.

Another preferred configuration of the tool provides that the die punch has several cutting tools and is formed as a multiple tool, in which the cutting tools may be activatable individually by an activation device for workpiece machining. Such a multiple tool is also called a multitool. This comprises several cutting tools or punch inserts, which may be transferred by an activation device to a functional state for workpiece machining. In this case the cutting tool is held fixedly in an extended position relative to the main body of the die punch, whereas the other cutting tools may dip into the main body in workpiece machining. The activation device may be a so-called indexing wheel, which can be controlled by a rotary movement radially to the positioning axis via the tool receptacle of the machine tool. A selection of the cutting tools for the pending workpiece machining can be enabled by this.

Another aspect of the invention features a machine tool for cutting and/or forming planar workpieces, preferably metal sheets. This comprises an upper tool, which is movable along a stroke axis by a stroke drive device in the direction of a workpiece to be machined by an upper tool and in an opposite direction and which can be positioned along an upper positioning axis running perpendicular to the stroke axis and is traversable along the upper positioning axis by a motor drive assembly. This further comprises a lower tool, which is oriented towards the upper tool and is movable along a stroke axis by a lower stroke drive device in the direction of the upper tool and in the opposite direction and may be positioned along a lower positioning axis, which is oriented perpendicular to the stroke axis of the upper tool and is movable by a lower motor drive assembly along the lower positioning axis. With a controller by which the motor drive assemblies for traversing of the upper and lower tool can be actuated, the traversing movement of the upper tool along the upper positioning axis and the traversing movement of the lower tool along the lower positioning axis are each actuated independently of one another. A tool according to one of the previously described embodiments is provided for cutting and/or forming workpieces. Due to the independent control of the upper tool relative to the lower tool along one traversing axis respectively, which lies in the workpiece plane of the workpiece, and a superposed control of a stroke movement respectively along a stroke axis, which lies perpendicular to the workpiece plane and may also take place independently of one another, a relative movement or relative displacement may take place between the upper tool and/or lower tool in a variety of ways along an inclined axis. A superposing of a traversing movement along the stroke axes and along the axis in the workpiece plane can also take place at the same time, so that a traversing movement directed towards the workpiece or a web-type traversing movement can be actuated, in order subsequently at least to cut free one workpiece part of the workpiece.

Due to the configuration of the tool, the association of the cutting edge of the cutting tool on the upper tool with an inner or outer counter cutting edge can be shortened to reduce the cycle time and increase productivity. Moreover, the discharge time can be reduced by the option of discharging the cut-free workpiece parts through the openings of the lower tool and outside the lower tool. Parts sorting can also be undertaken. An enlarged parts spectrum can be machined.

It is preferably provided that the machine tool has a C-shaped or closed machine frame. A C-shaped machine frame can be provided depending on the size and the expansion level of the machine. This C-shaped machine frame comprises an upper and lower horizontal frame limb as well as a vertical frame limb arranged in between. Alternatively a closed machine frame can be provided, in which two vertical frame limbs are provided spaced at an interval from one another between the two horizontal frame limbs.

A further aspect of the invention features a method for cutting and/or forming planar workpieces, in particular metal sheets, in which an upper tool, which is movable along a stroke axis by a stroke drive device in the direction of a workpiece to be machined by the upper tool and in an opposite direction and which may be positioned along an upper positioning axis running perpendicular to the stroke axis, is moved along the upper positioning axis by a motor drive assembly, and in which a lower tool, which is oriented towards the upper tool and may be positioned along a lower positioning axis, which is oriented perpendicular to the stroke axis of the upper tool, is moved along the lower positioning axis by a motor drive assembly and in which the motor drive assemblies for moving the upper and lower tool are actuated by a controller, wherein a tool is used in one of the embodiments described previously for machining the workpieces. The traversing movement of the upper tool along the upper positioning axis and the traversing movement of the lower tool along the lower positioning axis are each controlled independently of one another. A traversing movement of the upper tool and/or of the lower tool specifically adapted to the punch machining may be carried out by this. In particular, when cutting workpiece parts free from a workpiece, a reduction in the cycle time can be achieved, as a swift orientation of the tool to the position of the remaining connection between the workpiece and the workpiece part is possible. The workpiece can be held in a resting position during the traversing movement of the lower tool and/or of the upper tool. Alternatively, a traversing movement of the workpiece within the workpiece plane into the machine tools can also be superposed in addition to the traversing movement of the upper tool and/or the lower tool.

A traversing movement of the upper tool or of the lower tool or of both relative to one another is preferably controlled to determine a spacing and/or an orientation of the cutting edge and the counter cutting edge. An adaptation to the cutting gap width between the upper tool and the counter cutting edge as well as an orientation of the tool for the introduction of a cutting gap and/or of a remaining connection to be cut free or of a microjoint is facilitated by this.

It can further be preferably provided that a workpiece part, if this is bigger in dimension than the opening of the lower tool, is cut free by the orientation of the cutting edge of the upper tool to the outer counter cutting edge of the lower tool and that a workpiece part that is smaller in dimension than the opening in the lower tool is cut free by the orientation of the cutting edge of the upper tool to the inner counter cutting edge of the lower tool and is discharged through the opening. A separation and/or sorting of workpiece parts can take place, for example, due to this, which takes place according to the size of the workpiece parts to be cut free. Alternatively sorting can take place by good part and waste part, which is selected in respect of the size relative to the opening of the lower tool or can also be determined by the user.

In a traversing movement of the workpiece between the upper tool and the lower tool for positioning the workpiece for a new punching process or for punching or cutting the workpiece part free from the workpiece, the inner and/or outer counter cutting edge of the lower tool is preferably rotated about the longitudinal axis of the lower tool, so that the counter cutting edge or counter cutting edges of the lower tool is or are oriented tangentially to the traversing direction of the workpiece or parallel to the traversing direction of the workpiece. This orientation of the lower tool can also be tracked as a function of the traversing movement of the workpiece, in which a corresponding rotation movement of the lower tool is adapted to the traversing movement of the workpiece. The process reliability is increased by this, as a lowering of individual workpiece parts below the workpiece plane taking place if applicable with respect to the workpiece plane does not lead to catching or jamming with the counter cutting edge.

DESCRIPTION OF DRAWINGS

The invention and further advantageous embodiments and developments thereof will be described and explained in greater detail hereinafter with reference to the examples shown in the drawings. The features inferred from the description and the drawings can be applied in accordance with the invention individually or in any combination. In the drawings.

DETAILED DESCRIPTION

Figure 1:
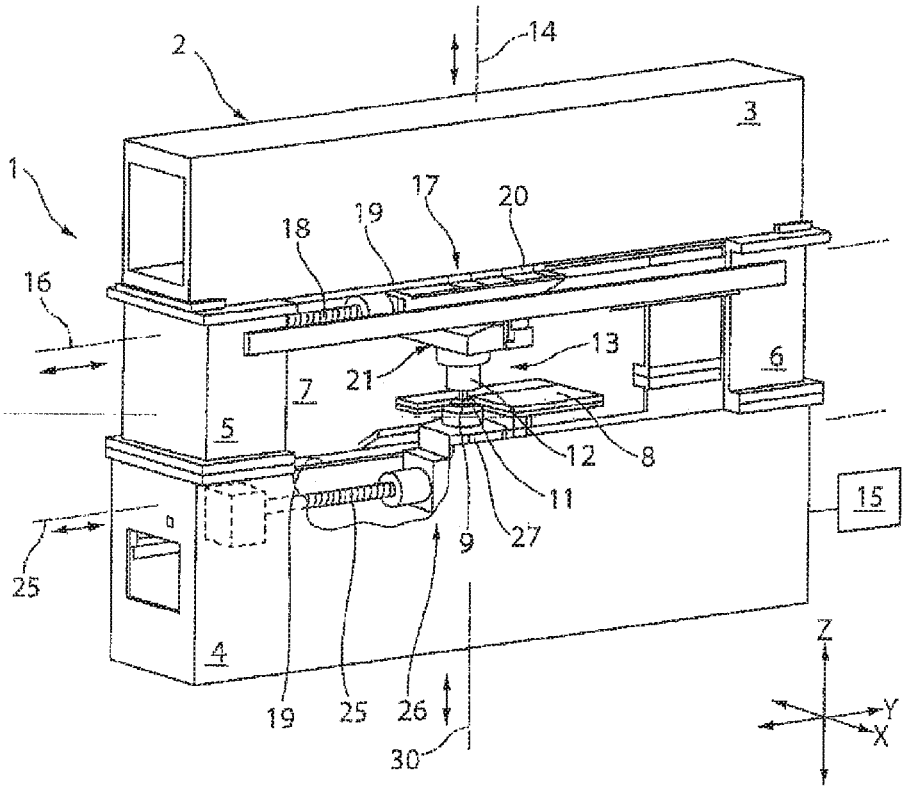
FIG. 1 shows a perspective view of the machine tool.

FIG. 1 shows a machine tool 1 which is configured as a punch press. This machine tool 1 comprises a supporting structure with a closed machine frame 2. This comprises two horizontal frame limbs 3, 4 and two vertical frame limbs 5 and 6. The machine frame 2 surrounds a frame interior 7, which forms the working area of the machine tool 1 with an upper tool 11 and a lower tool 9.

The machine tool 1 is used to machine planar workpieces 10, which for the sake of simplicity have not been shown in FIG. 1 and can be arranged in the frame interior 7 for machining purposes. A workpiece 10 to be machined is placed on a workpiece support 8 provided in the frame interior 7. The lower tool 9, for example in the form of a die, is mounted in a recess in the workpiece support 8 on the lower horizontal frame limb 4 of the machine frame 2. This die can be provided with a die opening. In the case of a punching operation the upper tool 11 formed as a punch dips into the die opening of the lower tool formed as a die.

The upper tool 11 and lower tool 9, instead of being formed by a punch and a die for punching, can also be formed by a bending punch and a bending die for shaping workpieces 10.

The upper tool 11 is fixed in a tool receptacle on a lower end of a ram 12. The ram 12 is part of a stroke drive device 13, by means of which the upper tool 11 can be moved in a stroke direction along a stroke axis 14. The stroke axis 14 runs in the direction of the Z axis of the coordinate system of a numerical controller 15 of the machine tool 1 indicated in FIG. 1. The stroke drive device 13 can be moved perpendicular to the stroke axis 14 along a positioning axis 16 in the direction of the double-headed arrow. The positioning axis 16 runs in the direction of the Y axis of the coordinate system of the numerical controller 15. The stroke drive device 13 receiving the upper tool 11 is moved along the positioning axis 16 by means of a motor drive 17.

The movement of the ram 12 along the stroke axis 14 and the positioning of the stroke drive device 13 along the positioning axis 16 are achieved by means of a motor drive 17, which can be configured in the form of a drive assembly 17, in particular a spindle drive assembly, with a drive spindle 18 running in the direction of the positioning axis 16 and fixedly connected to the machine frame 2. The stroke drive device 13, in the event of movements along the positioning axis 16, is guided on three guide rails 19 of the upper frame limb 3, of which two guide rails 19 can be seen in FIG. 1. The other guide rail 19 runs parallel to the visible guide rail 19 and is distanced therefrom in the direction of the X axis of the coordinate system of the numerical controller 15. Guide shoes 20 of the stroke drive device 13 run on the guide rails 19. The mutual engagement of the guide rail 19 and the guide shoe 20 is such that this connection between the guide rails 19 and the guide shoes 20 can also bear a load acting in the vertical direction. The stroke device 13 is mounted on the machine frame 2 accordingly via the guide shoes 20 and the guide rails 19. A further component of the stroke drive device 13 is a wedge gear 21, by means of which the position of the upper tool 11 relative to the lower tool 9 is adjustable.

The lower tool 9 is received movably along a lower positioning axis 25. This lower positioning axis 25 runs in the direction of the Y axis of the coordinate system of the numerical controller 15. The lower positioning axis 25 is preferably oriented parallel to the upper positioning axis 16. The lower tool 9 can be moved directly on the lower positioning axis 16 by means of a motor drive assembly 26 along the positioning axis 25. Alternatively or additionally the lower tool 9 can also be provided on a stroke drive device 27, which is movable along the lower positioning axis 25 by means of the motor drive assembly 26. This drive assembly 26 is preferably configured as a spindle drive assembly. The lower stroke drive device 27 can correspond in respect of its structure to the upper stroke drive device 13. The motor drive assembly 26 likewise may correspond to the motor drive assembly 17.

The lower stroke drive device 27 is mounted displaceably on guide rails 19 associated with a lower horizontal frame limb 4. Guide shoes 20 of the stroke drive device 27 run on the guide rails 19, such that the connection between the guide rails 19 and guide shoes 20 at the lower tool 9 can also bear a load acting in the vertical direction. Accordingly, the stroke drive device 27 is also mounted on the machine frame 2 via the guide shoes 20 and the guide rails 19, moreover at a distance from the guide rails 19 and guide shoes 20 of the upper stroke drive device 13. The stroke drive device 27 may also comprise a wedge gear 21, by means of which the position or height of the lower tool 9 along the Z axis is adjustable.

By means of the numerical controller 15, both the motor drives 17 for a traversing movement of the upper tool 11 along the upper positioning axis 16 and the one or more motor drives 26 for a traversing movement of the lower tool 9 along the lower positioning axis 25 can be controlled independently of one another. The upper and lower tools 11, 9 are thus movable synchronously in the direction of the Y axis of the coordinate system. An independent traversing movement of the upper and lower tools 11, 9 in different directions can also be controlled. This independent traversing movement of the upper and lower tools 11, 9 can be controlled simultaneously. As a result of the decoupling of the traversing movement between the upper tool 11 and the lower tool 9, an increased versatility of the machining of workpieces 10 can be attained. The upper and lower tools 11, 9 can also be configured to machine the workpieces 10 in many ways.

Figure 2:
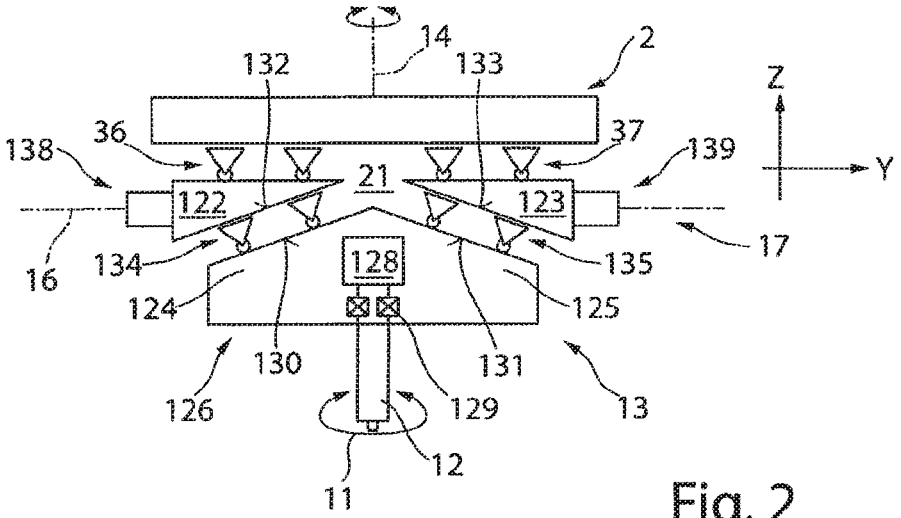
FIG. 2 shows a schematic depiction of the fundamental structure of a stroke drive device and a motor drive according to FIG. 1.

One component of the stroke drive device 13 is the wedge gear 21, which is shown in FIG. 2. The wedge gear 21 comprises two drive-side wedge gear elements 122, 123, and two output-side wedge gear elements 124, 125. The latter are combined structurally to form a unit in the form of an output-side double wedge 126. The ram 12 is mounted on the output-side double wedge 126 so as to be rotatable about the stroke axis 14. A motor rotary drive device 128 is accommodated in the output-side double wedge 126 and advances the ram 12 about the stroke axis 14 as necessary. Here, both a left-handed and a right-handed rotation of the ram 12 in accordance with the double-headed arrow in FIG. 2 are possible. A ram mounting 129 is shown schematically. On the one hand, the ram mounting 129 allows low-friction rotary movements of the ram 12 about the stroke axis 14, and on the other hand the ram mounting 129 supports the ram 12 in the axial direction and accordingly dissipates loads that act on the ram 12 in the direction of the stroke axis 14 in the output-side double wedge 126.

The output-side double wedge 126 is defined by a wedge surface 130, and by a wedge surface 131 of the output-side gear element 125. Wedge surfaces 132, 133 of the drive-side wedge gear elements 122, 123 are arranged opposite the wedge surfaces 130, 131 of the output-side wedge gear elements 124, 125. By means of longitudinal guides 134, 135, the drive-side wedge gear element 122 and the output-side wedge gear element 124, and also the drive-side wedge gear element 123 and the output-side wedge gear element 125, are guided movably relative to one another in the direction of the Y axis, that is to say in the direction of the positioning axis 16 of the stroke drive device 13.

The drive-side wedge gear element 122 has a motor drive unit 138, and the drive-side wedge gear element 123 has a motor drive unit 139. Both drive units 138, 139 together form the spindle drive assembly 17.

The drive spindle 18 shown in FIG. 1 is common to the motor drive units 138, 139, as is the stroke drive device 13, 27 that is mounted on the machine frame 2 and consequently on the supporting structure.

The drive-side wedge gear elements 122, 123 are operated by the motor drive units 138, 139 in such a way that said wedge gear elements move, for example, towards one another along the positioning axis 16, whereby a relative movement is performed between the drive-side wedge gear elements 122, 123 on the one hand and the output-side wedge gear elements 124, 125 on the other hand. As a result of this relative movement, the output-side double wedge 126 and the ram 12 mounted thereon is moved downwardly along the stroke axis 14. The punch mounted on the ram 12 for example as the upper tool 11 performs a working stroke and in so doing machines a workpiece 10 mounted on the workpiece rest 28, 29 or the workpiece support 8. By means of an opposite movement of the drive wedge elements 122, 123, the ram 12 is in turn raised or moved upwardly along the stroke axis 14.

The above-described stroke drive device 13 according to FIG. 2 is preferably of the same design as the lower stroke drive device 27 and receives the lower tool 9.

Figure 3:
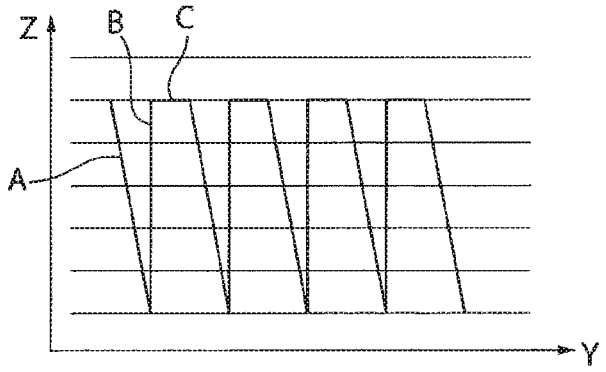
FIG. 3 shows a schematic graph of a superposed stroke movement in the Y and Z direction of the ram according to FIG. 1.

FIG. 3 shows a schematic graph of a possible stroke movement of the ram 12. The graph shows a stroke profile along the Y axis and the Z axis. By means of a superposed control of a traversing movement of the ram 12 along the stroke axis 14 and along the positioning axis 16, an obliquely running stroke movement of the stroke ram 12 downwardly towards the workpiece 10 can, for example, be controlled, as shown by the first straight line A. Once the stroke has been performed, the ram 12 can then be lifted vertically, for example, as illustrated by the straight line B. For example, an exclusive traversing movement along the Y axis is then performed in accordance with the straight line C, in order to position the ram 12 for a new working position relative to the workpiece 10. For example, the previously described working sequence can then be repeated. If the workpiece 10 is moved on the workpiece rest surface 28, 29 for a subsequent machining step, a traversing movement along the straight line C may also be omitted.

The possible stroke movement of the ram 12 on the upper tool 11 shown in the graph in FIG. 3 is preferably combined with a lower tool 9 that is held stationary. Here, the lower tool 9 is positioned within the machine frame 2 in such a way that, at the end of a working stroke of the upper tool 11, the upper and lower tools 11, 9 assume a defined position.

This exemplary, superposed stroke profile can be controlled for both the upper tool 11 and the lower tool 9. Depending on the machining of the workpiece 10 that is to be performed, a superposed stroke movement of the upper tool and/or lower tool 11, 9 can be controlled.

Figure 4:
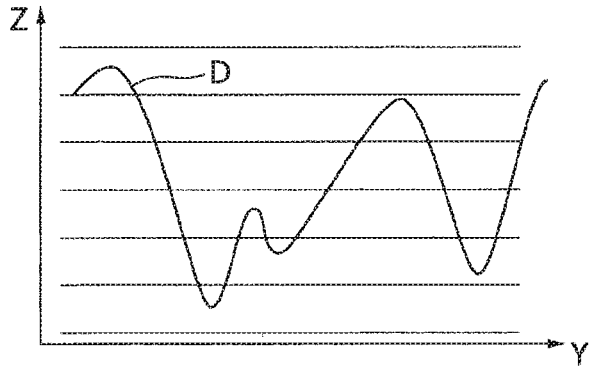
FIG. 4 shows a schematic graph of a further superposed stroke movement in the Y and Z direction of the ram according to FIG. 1.

FIG. 4 shows a schematic graph illustrating a stroke movement of the ram 12 in accordance with the line D, shown by way of example, along a Y axis and a Z axis. In contrast to FIG. 3, it is provided in this exemplary embodiment that a stroke movement of the ram 12 can pass through a curve profile or arc profile by controlling a superposition of the traversing movements in the Y direction and Z direction appropriately by the controller 15. By means of a versatile superposition of this kind of the traversing movements in the X direction and Z direction, specific machining tasks can be performed. The control of a curve profile of this kind can be provided for the upper tool 11 and/or the lower tool 9.

Figure 5:
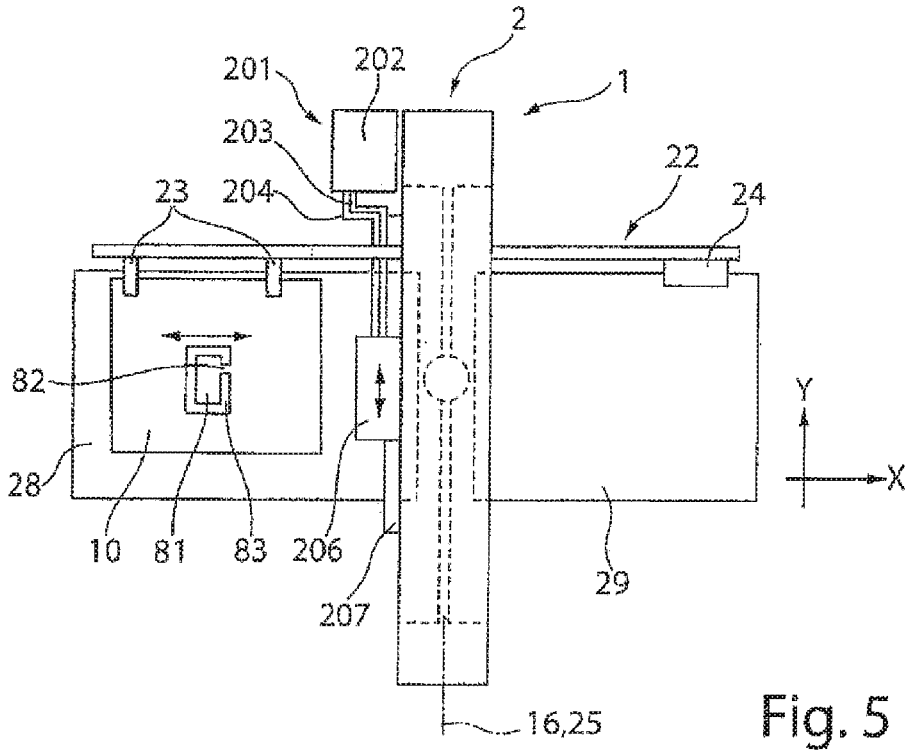
FIG. 5 shows a schematic view from above of the machine tool according to FIG. 1 with workpiece rest surfaces.

FIG. 5 shows a schematic view of the machine tool 1 according to FIG. 1. Workpiece rests 28, 29 extend laterally in one direction each on the machine frame 2 of the machine tool 1. The workpiece rest 28 can, for example, be associated with a loading station (not shown in greater detail), by means of which unmachined workpieces 10 are placed on the workpiece rest 28. A feed device 22 is provided adjacently to the workpiece rest 28, 29 and comprises a plurality of grippers 23 in order to grip the workpiece 10 placed on the workpiece rest 28. The workpiece 10 is guided through the machine frame 2 in the X direction by means of the feed device 22. The feed device 22 may also preferably be controlled so as to be movable in the Y direction. A free traversing movement of the workpiece 10 in the X-Y plane may thus be provided. Depending on the work task, the workpiece 10 may be movable by the feed device 22 both in the X direction and against the X direction. This movement of the workpiece 10 can be adapted to a movement of the upper tool 11 and lower tool 9 in and against the Y direction for the machining work task at hand.

The further workpiece rest 29 is provided on the machine frame 2 opposite the workpiece rest 28. This further workpiece rest can be associated, for example, with an unloading station. Alternatively, the loading of the unmachined workpiece 10 and unloading of the machined workpiece 10 having workpieces 81 can also be associated with the same workpiece rest 28, 29.

The machine tool 1 may furthermore comprise a laser machining device 201, in particular a laser cutting machine, which is shown merely schematically in a plan view in FIG. 5. This laser machining device 201 may be configured, for example, as a CO2 laser cutting machine. The laser machining device 201 comprises a laser source 202, which generates a laser beam 203, which is guided by means of a beam guide 204 (shown schematically) to a laser machining head, in particular laser cutting head 206, and is focused therein. The laser beam 204 is then oriented perpendicularly to the surface of the workpiece 10 by a cutting nozzle in order to machine the workpiece 10. The laser beam 203 acts on the workpiece 10 at the machining location, in particular cutting location, preferably jointly with a process gas beam. The cutting point, at which the laser beam 203 impinges on the workpiece 10, is adjacent to the machining point of the upper tool 11 and lower tool 9.

The laser cutting head 206 is movable by a linear drive 207 having a linear axis system at least in the Y direction, preferably in the Y and Z direction. This linear axis system, which receives the laser cutting head 206, can be associated with the machine frame 2, fixed thereto or integrated therein. A beam passage opening can be provided in the workpiece rest 28 below a working space of the laser cutting head 206. A beam capture device for the laser beam 21 may be provided preferably beneath the beam passage opening 210. The beam passage opening and as applicable the beam capture device can also be configured as one unit.

The laser machining device 201 may alternatively also comprise a solid-state laser as laser source 202, the radiation of which is guided to the laser cutting head 206 with the aid of a fiber-optic cable.

The workpiece rest 28, 29 can extend up to directly on the workpiece support 8, which at least partially surrounds the lower tool 9. Within a resultant free space created therebetween, the lower tool 9 is movable along the lower positioning axis 25 in and against the Y direction.

For example, a machined workpiece 10 lies on the workpiece rest 28 and has a workpiece part 81 cut free by a cutting gap 83, for example by punching or by laser beam machining, apart from a remaining connection 82. The workpiece 81 is held in the workpiece 10 or the remaining sheet skeleton by means of this remaining connection. In order to separate the workpiece part 81 from the workpiece 10, the workpiece 10 is positioned by means of the feed device 22 relative to the upper and lower tool 11, 9 for a separation and discharge step. Here, the remaining connection 82 is separated by a punching stroke of the upper tool 11 relative to the lower tool 9. The workpiece part 81 can, for example, be discharged downwardly by partially lowering the workpiece support 8. Alternatively, in the case of larger workpiece parts 81, the cut-free workpiece part 81 may be transferred back again to the workpiece rest 28 or onto the workpiece rest 29 in order to unload the workpiece part 81 and the sheet skeleton. Small workpiece parts 81 may also be discharged optionally through an opening in the lower tool 9.

Figure 6:
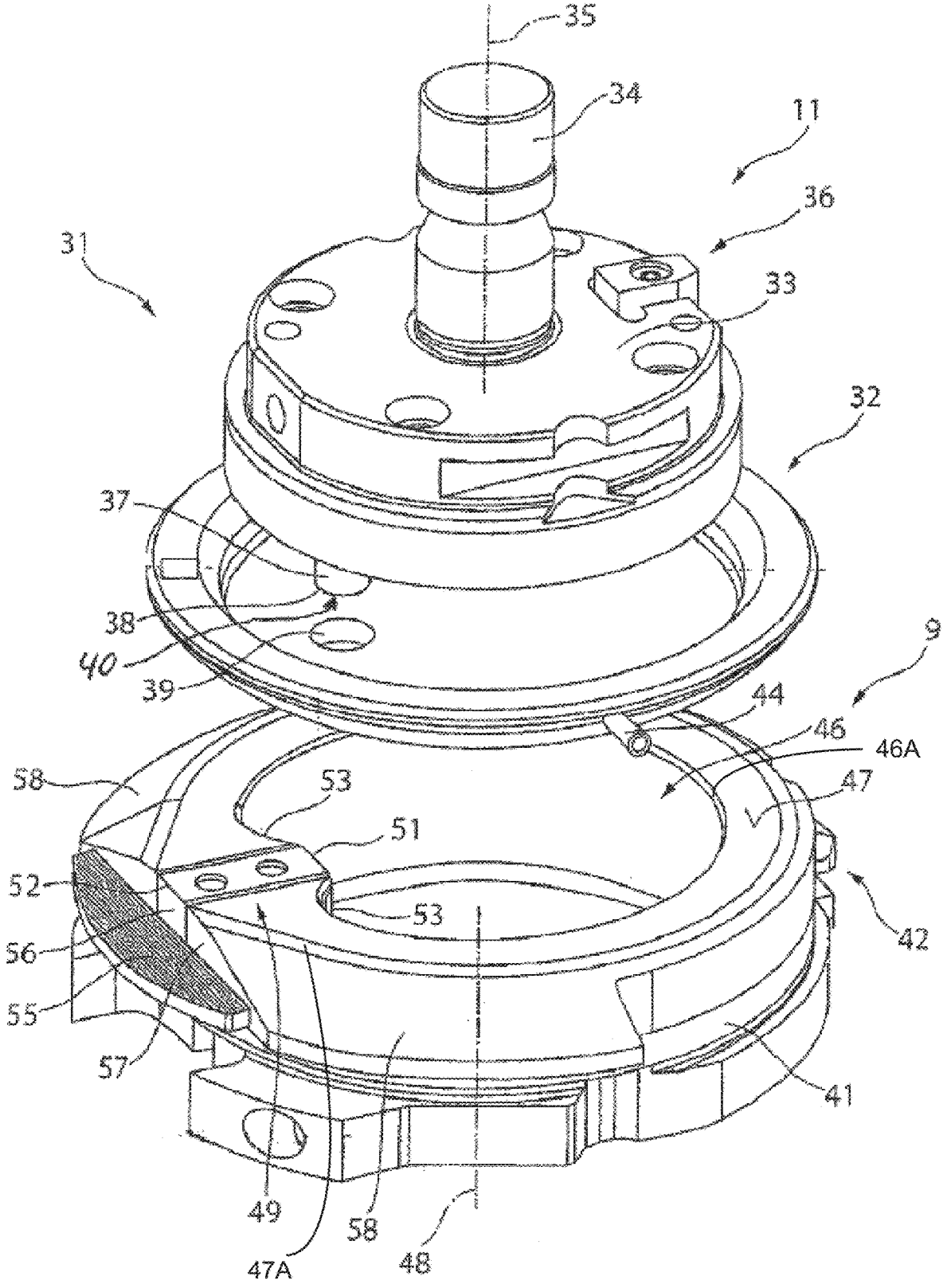
FIG. 6 shows a perspective view of a first embodiment of a tool.

FIG. 6 shows a perspective view of the tool 31, consisting of an upper tool 11, which is formed as a punch, for example, and a lower tool 9, which is formed as a die, for example.

The upper tool 11 comprises a main body 33 with a clamping shaft 34 and an adjusting or indexing element or adjusting or indexing wedge 36. The clamping shaft 34 serves to hold the upper tool 11 in the machine-side upper tool receptacle. The orientation of the upper tool 11 and the rotational position of the upper tool 11 are determined here by the indexing wedge 36. The orientation of the cutting tool 37 on the main body 33 of the upper tool 11 is set in turn by this and the upper tool 11 is oriented relative to the lower tool 9. The lower tool 9 likewise comprises a main body 41, which is suitable to be fixed in the machine-side lower tool receptacle with a defined rotational position, for example by at least one adjusting element 42.

The cutting tool 37 is provided on an underside of the main body 33 of the upper tool 11. This is formed with a round cross section, for example, and thus has a circular cutting edge 38. Alternatively it can be provided that the geometry of the cutting edge 38 is rectangular or square, or has a corresponding contour profile. The cutting edge 38 may also be formed on an inclined cutting tool 37. The cutting tool 37 may also have a cutting edge 38 with a groove. The cutting tool 37 may have an end face 40. In the case of an inclined cutting tool 37, the end face 40 may also be inclined. In the case of a cutting tool 37 with a groove, the end face 40 is formed by the circumferential cutting edge 38. This points towards the lower tool 9 and is preferably bordered by the cutting edge 38.

Associated with the upper tool 11 is the scraper 32, which has an opening 39, which may correspond to the cutting edge 38 in its geometry. This scraper 32 is taken up in the upper machine-side tool receptacle by guides such as pins 44, for example, so that it is also movable along the stroke axis 14 relative to the lower tool 9. Holding down of a workpiece 10 relative to the lower tool 9 may be achieved by this, for example, as soon as the upper tool 11 is removed upwardly along the stroke axis 14. The scraper 32 can likewise be moved simultaneously with the upper tool 11 along the stroke axis 14 and perform a scraping movement following lifting from the lower tool 9.

In the main body 41 the lower tool 9 has an opening 46, which is bordered by a circumferential rest surface 47. The rest surface 47 may also extend only in sections or be formed by several elements. The opening 46 has a circular contour, for example. This can also be formed differently from this. A cutting plate 49 is provided on the main body 41 of the lower tool 9. This cutting plate 49 is preferably formed detachably as a cutting insert. According to the first embodiment, this cutting plate 49 has an inner counter cutting edge 51, which is oriented and arranged towards the opening 46. Furthermore, the cutting plate 49 has an outer counter cutting edge 52. The outer counter cutting edge 52 may be oriented towards an outer side bordering the rest surface 47 or be provided on this outer side. Alternatively it can be provided that the inner counter cutting edge and the outer counter cutting edge 51, 52 are each formed on a separate cutting plate 49. The rest surface 47 can merge flush into the counter cutting edge 51, 52. The counter cutting edge 51, 52 preferably lies deeper than the rest surface 47 in order to avoid damage such as scratches, for example, on the underside of the metal sheet. The counter cutting edge 51, 52 may also be oriented flush with an end face or a flat portion 57 or a guard strip 59 or protrude slightly. Furthermore, the rest surface 47 may be formed in an area adjoining the cutting plate 49 in such a way that the rest surface 47 corresponds in the annular width at least to the length of the cutting plate 49.

The inner counter cutting edge 51 is arranged on a projection 53 emerging in the direction of the opening 46. The inner counter cutting edge 51 is projecting radially inwardly with respect to an opening edge 46A of the opening 46 and an edge 47A bordering the opening 46 relative to the rest surface 47. On cutting free by the cutting edge 38 of the cutting tool 37, a workpiece part 81 can thereby enter the opening 46 and be discharged downwardly through the opening 46.

Provided outside of the opening 46 of the lower tool 9 is a discharge surface 55, which is associated with the outer counter cutting edge 52. This discharge surface 55 is preferably inclined falling away outwardly with respect to the rest surface 47. Workpiece parts 81 cut free by way of the outer counter cutting edge 52 may be removed outwardly thereby via the discharge surface 55, to be supplied to a collection container or waste container, for example. The discharge surface 55 is preferably attached interchangeably to the main body 41 of the lower tool 9. It is provided in the exemplary embodiment that the discharge surface 55 has a web section (not shown in greater detail), which extends underneath the cutting plate 49, so that following attachment of the cutting plate 49 the discharge surface 55 is held in the main body 41 by clamping.

The discharge surface 55 is arranged recessed with respect to the outer cutting edge 52 by a punch face 56.

The main body 41 of the lower tool 9 has laterally adjoining flat portions 59 flush with the cutting face 56 of the cutting plate 49. The flat portions 59 are oriented tangentially to the opening 46. The outer counter cutting edge 52 bordering a top portion 47A of the rest surface 47 of the lower tool 9 are rounded or chamfered. Provided on the main body 41 of the lower tool 9 outside of the rest surface 47 is an approach ramp 58. This approach ramp 58 transitions smoothly into the rest surface 47. This approach ramp 58 is bordered by the flat portion 57. In a lateral view of the punch face 56 and outer counter cutting edge 52 a roof-shaped profile is formed. A radially outer edge of the approach ramp 58 is recessed with respect to the rest surface 47. The approach ramp 58 extends, starting from the outer counter cutting edge 52, at least in an angular range of at least 30° relative to the positioning axis 48. The approach ramp 58 preferably extends respectively starting from the outer counter cutting edge 52 by up to 90°. On traversing of the machined workpiece 10 with workpiece parts 81 held by remaining connections 82, it is made possible by such an approach ramp 58 that these parts slide on the approach ramp 58 onto the rest surface 47 of the lower tool 9 and thus catching with the counter cutting edges 51, 52 is prevented.

The approach ramps 58 can likewise be provided interchangeably on the main body 41.

Figure 8:
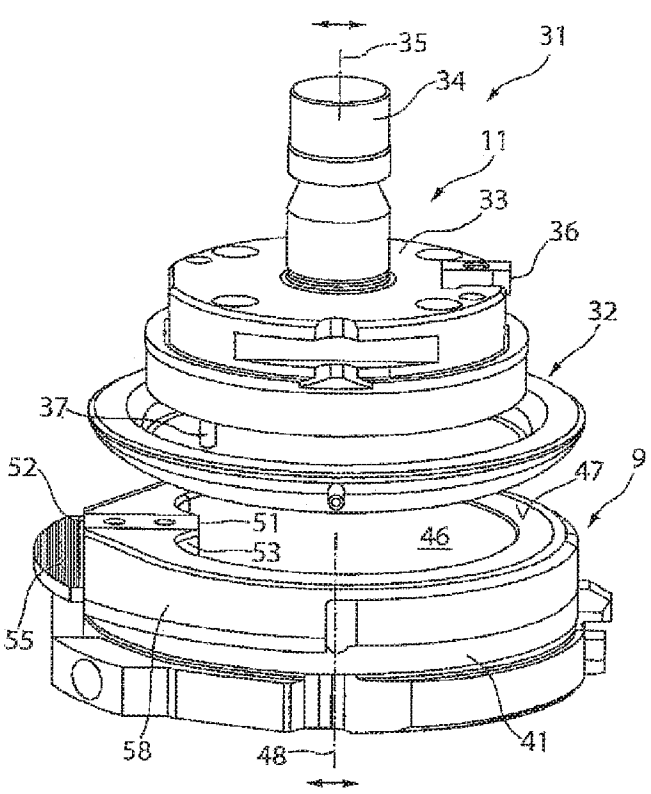
FIG. 8 shows a perspective view of the first embodiment of the tool in a second working position.
Figure 7:
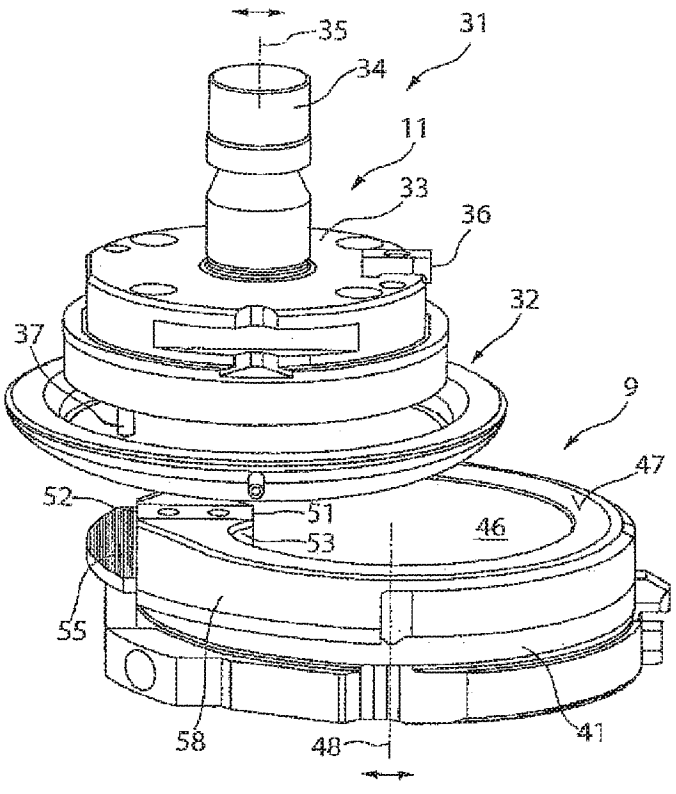
FIG. 7 shows a perspective view of the first embodiment of the tool in a first drive position.

FIG. 7 shows a first working position of the tool 31, in which the upper tool 11 with the cutting tool 37 is associated with an outer counter cutting edge 52 of the lower tool 9. In FIG. 8 a perspective side view of a further working position of the tool 31 is depicted, in which the cutting tool 37 of the upper tool 11 is oriented towards the inner counter cutting edge 51 of the lower tool 9. From a comparison of the first working position shown in FIG. 7 with the further working position shown in FIG. 8, it is clear that a small traversing movement of the upper tool 11 relative to the lower tool 9 and a relative movement of the lower tool 9 to the upper tool 11 along one of the positioning axes 16, 25 (FIG. 1) or the two positioning axes 16, 25 is sufficient to bring about a change between cutting free of a workpiece part 81 from the workpiece 10 on the inner counter cutting edge 51 and the outer cutting edge 52. In this exemplary embodiment a rotary movement of the upper tool 11 and of the lower tool 9 about the respective positioning axis 35, 48 may even be dispensable.

Figure 9:
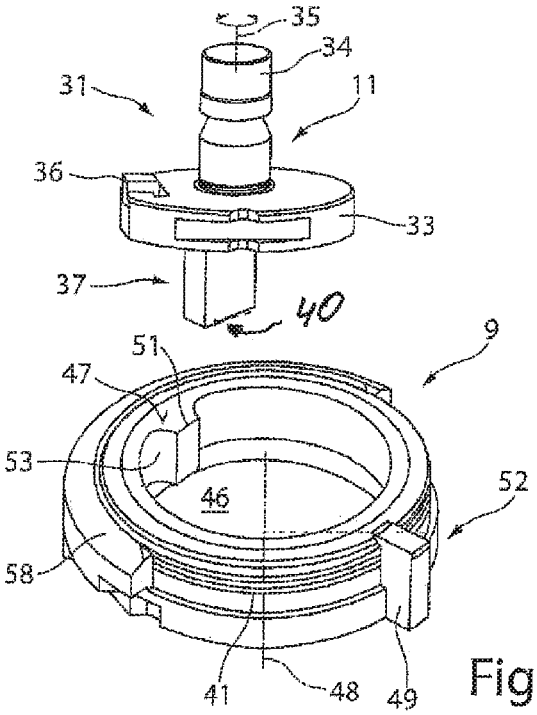
FIG. 9 shows a perspective view of an alternative embodiment of the tool in FIG. 6.

FIG. 9 shows a view in perspective of an alternative embodiment of the tool 31 in FIG. 6. In the case of this tool 31, an upper tool 11 is provided, for example, which has a cutting tool 37 with a rectangular cutting edge 38. An upper tool 11 of this kind can also be used with a lower tool 9 according to FIG. 4.

The lower tool 9 in FIG. 9 deviates from the lower tool 9 according to FIG. 4 in that the inner and outer counter cutting edge 51, 52 are formed separately to one another and that these are also positioned offset in the angular position to one another relative to the opening 46 on the main body 41. The inner counter cutting edge 51 and the outer counter cutting edge 52 are preferably arranged offset by 180° to one another on the main body 41.

The inner and outer counter cutting edge 51, 52 can also be oriented in other angular positions. Several inner and/or outer counter cutting edges 51, 52 can also be provided on the lower tool 9. The number of inner and outer counter cutting edges 51, 52 can also deviate from one another. Each of these cutting edges 38 and counter cutting edges 51, 52 can have a different spacing from the positioning axis 35, 48 of the respective upper tool 11 and lower tool 9. The inner and/or outer cutting edges 38 and counter cutting edges 51, 52 can also have a closed contour.

It is provided in this embodiment, for example, that the inner counter cutting edge 51 is formed directly on the main body 41. The outer counter cutting edge 52 is attached detachably to the main body 41. In this embodiment an approach ramp 58 is associated with the inner counter cutting edge 51, for example. Alternatively or in addition this approach ramp 58 may also be associated with the outer counter cutting edge 52.

Figure 10:
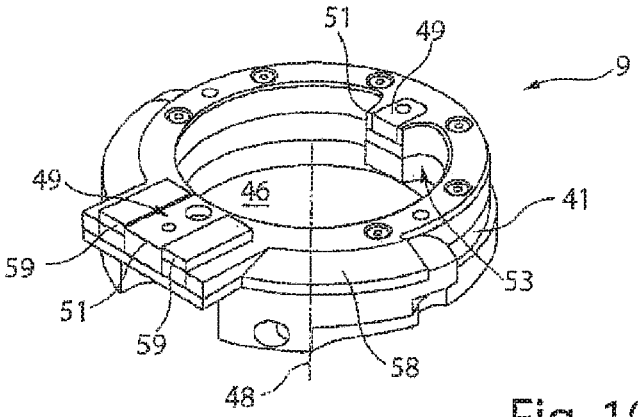
FIG. 10 shows a perspective view of another alternative embodiment of a lower tool of the tool in FIG. 6.

FIG. 10 shows a perspective view of an alternative embodiment of the lower tool 9 for a tool 31 according to FIG. 6. In this embodiment it is provided, for example, that the inner counter cutting edge 51 and the outer counter cutting edge 52 are each formed as a detachable cutting plate 49. These are preferably also arranged on the main body 41 and oriented to the rest surface 47 separately to one another. It is provided in this embodiment that the approach ramp 58 is attached to the main body 41 as a detachable attachment and the inner and outer counter cutting edge 51, 52 are bound in the approach ramp 58. A guard strip 59, which is preferably held in a flexibly soft manner, can additionally be associated on one or both sides with the outer cutting edge 52, for example.

Figure 11B:
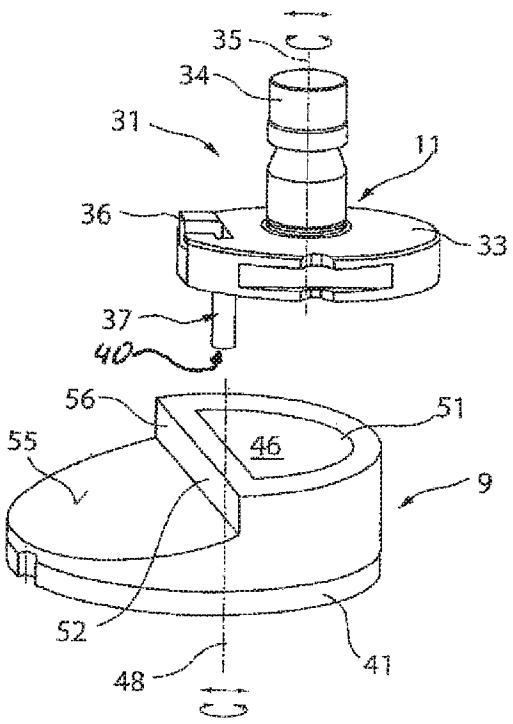
FIGS. 11A and 11B show a perspective view of another alternative embodiment of the tool in FIG. 6 in two different drive positions from one another.
Figure 11A:
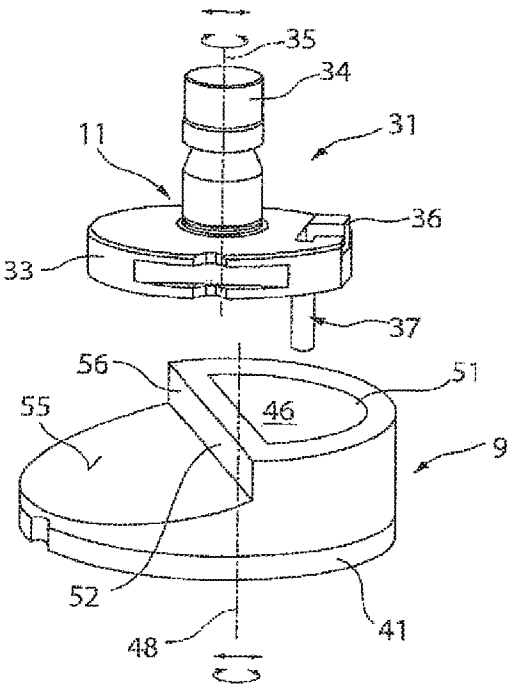

FIGS. 11A and 11B depict another alternative embodiment of the tool 31 in FIG. 6, wherein FIG. 11A shows a first working position and FIG. 11B a second working position of the tool 31. Provided in this embodiment is the upper tool 11, which corresponds to the embodiment in FIG. 6. The lower tool 9 deviates from the embodiment in FIG. 4 in that the opening 46 is formed semicircular or as an arc segment. An outer counter cutting edge 52 may be formed by this, which extends along the remaining diameter. The discharge surface 55 may be formed adjoining the outer counter cutting edge 52. This embodiment has the advantage that a very long outer counter cutting edge 52 may be formed. A border of the opening 46 may be formed as an inner counter cutting edge 51.

An orientation of the upper tool 11 relative to the lower tool 9 may be performed by a relative movement in the traversing direction along a workpiece plane of the upper tool 11 and/or the lower tool 9. Alternatively and/or in addition, a rotary movement of the upper tool 11 and/or of the lower tool 9 may be superposed.

Figure 12:
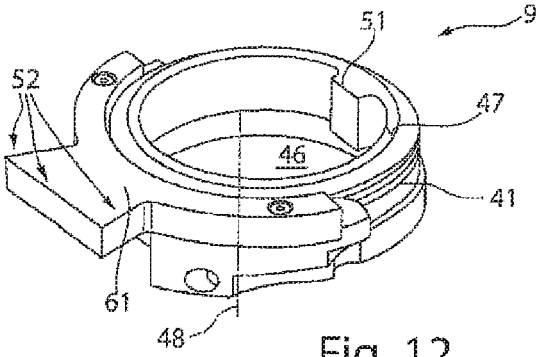
FIG. 12 shows a perspective view of another alternative embodiment of a lower tool of the tool in FIG. 6.

FIG. 12 shows a further alternative embodiment of the lower tool 9 for a tool 31 in FIG. 6. In the case of this lower tool 9 an inner counter cutting edge 51 is provided on the main body 41. This can also be formed as an insertable cutting plate 49. An interchangeable adapter plate 61 with at least one outer counter cutting edge 52 is provided separately to this. The outer counter cutting edge 52 consists in this case of three individual secondary cutting edges, for example. The secondary cutting edges can be oriented to one another trapezoidally or also in another way.

A lower tool 9 of this kind permits an increase in versatility with regard to the working position of the upper tool 11 relative to the outer counter cutting edge 52.

FIGS. 13A to 13D depict various working positions in the plan view of the lower tool 9 according to FIG. 12 with a hexagonal cutting tool 37 of the upper tool 11, for example.

Figure 13A:
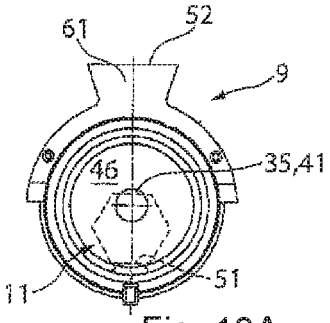
FIGS. 13A to 13D show schematic views of the lower tool according to FIG. 12 with different drive positions of an upper tool for cutting a workpiece part free.
Figure 13B:
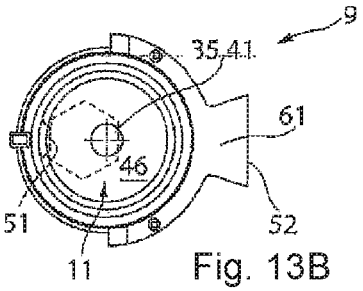

FIG. 13A shows a working position in which a cutting edge 38 of the cutting tool 37 is associated with the inner counter cutting edge 51. FIG. 13B differs from FIG. 13A in that the lower tool 9 is turned about its positioning axis 48, for example, without the lower tool 9 being moved in at least one movement direction. The upper tool 11 can be oriented relative to the inner counter cutting edge 51 by a rotation movement about its positioning axis 35 and a possibly necessary traversing movement along a positioning axis 16.

Figure 13C:
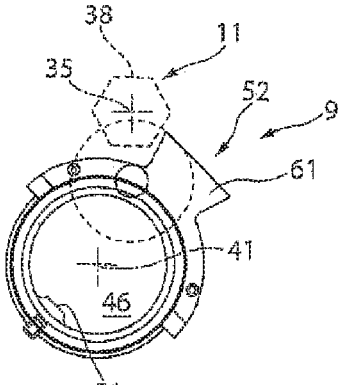

FIG. 13C shows a positioning of the cutting tool 37 of the upper tool 11 relative to the outer counter cutting edge 52 of the lower tool 9, in particular in an orientation relative to a secondary cutting edge. A defined angular position can be assumed thereby, for example, to cut the workpiece part 81 free from the workpiece 10.

Figure 13D:
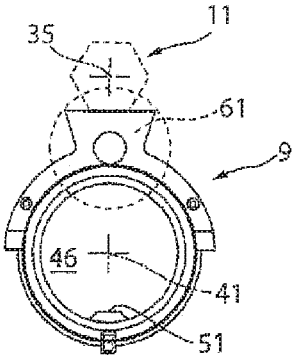

FIG. 13D depicts a further alternative working position of the cutting tool 37 of the upper tool 11 relative to the lower tool 9. It is clear from this compared with FIG. 13C that the cutting position is variable in a simple manner by a corresponding orientation or turning of the lower tool 9 about the positioning axis 48 and an association of the upper tool 11.

Figure 14:
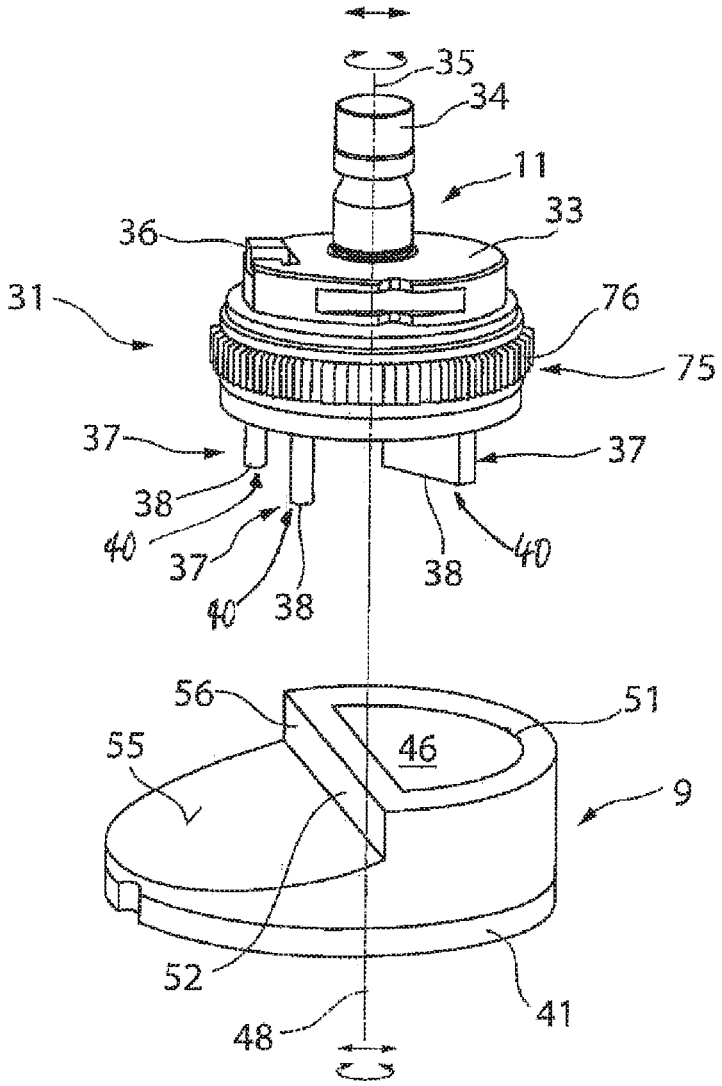
FIG. 14 shows a perspective view of another alternative embodiment of the tool in FIG. 11.

FIG. 14 shows a perspective view of an alternative embodiment of the tool 31 in FIGS. 11A and 11B. The lower tool 9 in this embodiment corresponds to FIGS. 11A and 11B. Reference is made in full to this figure description in this regard.

Deviating from the upper tool according to FIGS. 11A and 11B, it is provided that a punch is provided in this embodiment, which punch is formed as a multitool. A multitool of this kind comprises several cutting tools 37. These cutting tools 37 each have a cutting edge 38, wherein these differ from one another in shape and geometry. These cutting tools 37 are taken up in the main body 33 as punch inserts. Associated with the main body 33 is an activation device 75, which has outer toothing 76, for example. By means of a machine-side rotary drive, which is preferably provided on the tool receptacle, control is implemented for a rotary movement of the activation device 75 about the positioning axis 35. It is brought about by this rotary movement that an inner pressure surface (not shown) of the activation device 75, which surface is associated with the main body 33, can be positioned optionally relative to one of the cutting tools 37. The one cutting tool 37 is thereby positioned fixedly relative to the main body 33, whereas the other cutting tools 37 can dip into the main body 33 in a stroke movement along the stroke axis 14 and seating on the workpiece 10 with an increasing stroke movement.

A further increase in the versatility of the open contours to be machined can be facilitated by the use of a multitool of this kind as an upper tool 11. Furthermore, specific adaptation to the cutting gap width as a function of the material thickness of the workpiece 10 to be machined can be facilitated by the independent traversing movement of the upper tool 11 and of the lower tool 9 along the upper and lower positioning axis 16, 25. The statements regarding the embodiments described above otherwise apply.

The embodiments of the tool 31 described above have in common the fact that open contours can be cut in the workpiece 10. Open contours of this kind can be a remaining connection 82, for example, and a micro joint, for example. Furthermore, individual workpiece parts 81 can be cut free from the workpiece 10 by one or more working strokes. Furthermore, open contours of this kind can be formed by the introduction of a cutting gap 83, wherein several working strokes can be provided to form the cutting gap 83 or to punch out a waste part or good part as a workpiece part 81. As a result of the independent traversing movement of the upper tool 11 relative to the lower tool 9, simple adaptation may be made to the thickness of the workpiece 10 to be machined using the same cutting tool 37 and the at least one counter cutting edge 51, 52.

What is claimed is:

1. A planar workpiece processing device, comprising:

an upper tool comprising at least one cutting tool with at least one cutting edge and a clamping shaft, the upper tool having an upper stroke axis; and a lower tool comprising a main body having a rest surface for a workpiece, the lower tool having an opening in the main body to eject a workpiece part formed from the workpiece downwardly through the opening after the workpiece part is separated from the workpiece by the cutting tool, the lower tool having a lower stroke axis, wherein the lower tool comprises an inner counter cutting edge oriented and arranged towards the opening, wherein the lower tool comprises at least one outer counter cutting edge provided outside of the opening and associated with the rest surface, wherein one of the at least one outer counter cutting edge is oriented towards an outer side of the rest surface bordering the rest surface, wherein the inner counter cutting edge and the one of the at least one outer counter cutting edge are positioned on a same side of the main body with respect to the lower stroke axis, wherein a distance of the one of the at least one outer counter cutting edge from the lower stroke axis and a distance of the inner counter cutting edge from the lower stroke axis deviate from one another, wherein the inner counter cutting edge is formed as an inner open cutting edge that extends over a partial area along the opening and is different from an opening edge of the opening, and the one of the at least one outer counter cutting edge is formed as an outer open cutting edge that extends over a partial area along an outside of the rest surface on the main body of the lower tool, wherein the inner counter cutting edge is formed on a projection protruding into the opening, wherein the projection extends radially inwardly with respect to the opening edge of the opening and an edge bordering the opening relative to the rest surface, and wherein the upper tool and the lower tool are movable towards one another for machining the workpiece arranged therebetween with the at least one cutting edge of the at least one cutting tool of the upper tool and at least one of the inner counter cutting edge or the at least one outer counter cutting edge of the lower tool.

2. The planar workpiece processing device of claim 1, wherein a size of the opening in the main body of the lower tool is at least 1.5 times of an end face of the at least one cutting tool of the upper tool.

3. The planar workpiece processing device of claim 1, wherein the inner counter cutting edge and the one of the at least one outer counter cutting edge of the lower tool are positioned opposite one another relative to the rest surface and are oriented to one another without an angular offset or offset at an angle to one another relative to the rest surface.

4. The planar workpiece processing device of claim 1, wherein the inner counter cutting edge and the one of the at least one outer counter cutting edge of the lower tool are formed at least as a cutting plate arranged detachably on the main body of the lower tool.

5. The planar workpiece processing device of claim 1, wherein a punch face is connected to at least one of the inner counter cutting edge or the one of the at least one outer counter cutting edge opposite to the rest surface and directed downwardly.

6. The planar workpiece processing device of claim 1, wherein at least one guard strip is provided on at least one side of the lower tool adjacent to the at least one outer counter cutting edge.

7. The planar workpiece processing device of claim 1, wherein the at least one outer counter cutting edge includes one or more secondary cutting edges are attached detachably to the main body of the lower tool, and wherein the one or more secondary cutting edges are oriented projecting outwardly with respect to the main body and are provided on an adapter plate attached detachably to the main body.

8. The planar workpiece processing device of claim 1, wherein the lower stroke axis of the lower tool lies inside the opening in the main body, and wherein the cutting tool of the upper tool is positioned relative to the upper stroke axis.

9. The planar workpiece processing device of claim 1, wherein a discharge surface is associated with the at least one outer counter cutting edge of the lower tool, and wherein the discharge surface is attached detachably to the main body of the lower tool.

10. The planar workpiece processing device of claim 1, wherein the at least one outer counter cutting edge bordering the rest surface of the lower tool is rounded or chamfered.

11. The planar workpiece processing device of claim 1, wherein the rest surface has an approach ramp extending up to the one of the at least one outer counter cutting edge.

12. The planar workpiece processing device of claim 1, wherein the upper tool is formed as a multiple tool including a plurality of cutting tools, and wherein the cutting tools in the multiple tool are activatable individually for workpiece machining by an activation device.

13. A planar workpiece processing machine, comprising:

an upper tool comprising:

at least one cutting tool with at least one cutting edge, and a clamping shaft, wherein the upper tool is movable along an upper stroke axis by a first stroke drive device in a first direction of a workpiece to be machined and in a second direction, positionable along an upper positioning axis running perpendicular to the upper stroke axis, and movable by a first motor drive assembly with an upper traversing movement along the upper positioning axis;

a lower tool oriented towards the upper tool and comprising:

a main body having a rest surface for a workpiece, the lower tool having an opening in the main body to eject a workpiece part formed from the workpiece downwardly through the opening after the workpiece part is separated from the workpiece by the cutting tool, an inner counter cutting edge oriented and arranged towards the opening, and at least one outer counter cutting edge provided outside of the opening and associated with the rest surface and oriented towards an outer side of the rest surface bordering the rest surface, wherein the lower tool is movable along a lower stroke axis by a second stroke drive device in the first direction of the upper tool and in the second direction, positionable along a lower positioning axis oriented perpendicular to the upper stroke axis of the upper tool, and movable by a second motor drive assembly with a lower traversing movement along the lower positioning axis, wherein the inner counter cutting edge and one of the at least one outer counter cutting edge are positioned on a same side of the main body with respect to the lower stroke axis, wherein the inner counter cutting edge is formed as an inner open cutting edge that extends over a partial area along the opening and is different from an opening edge of the opening, and the one of the at least one outer counter cutting edge is formed as an outer open cutting edge that extends over a partial area along an outside of the rest surface on the main body of the lower tool, and wherein a distance of the one of the at least one outer counter cutting edge from the lower stroke axis and a distance of the inner counter cutting edge from the lower stroke axis deviate from one another;

wherein the inner counter cutting edge is formed on a projection protruding into the opening, wherein the projection extends radially inwardly with respect to the opening edge of the opening and an edge bordering the opening relative to the rest surface, and a controller configured to control the first and second motor drive assemblies for moving the upper tool and the lower tool, respectively, wherein the upper traversing movement of the upper tool along the upper positioning axis and the lower traversing movement of the lower tool along the lower positioning axis each are actuatable independently of one another, and wherein the upper tool and the lower tool are movable towards one another for machining the workpiece arranged therebetween, and wherein machining the workpiece comprises at least one of cutting the workpiece with the at least one cutting edge of the at least one cutting tool of the upper tool and at least one of the inner counter cutting edge or the at least one outer counter cutting edge of the lower tool or forming the workpiece.

14. The planar workpiece processing machine of claim 13, further comprising a C-shaped or a closed machine frame, in an interior of which the upper tool and the lower tool are movable.

* * * * *